US006592402B2

(12) United States Patent
Marceau et al.

(10) Patent No.: US 6,592,402 B2
(45) Date of Patent: Jul. 15, 2003

(54) ADHESIVE INTERFACE FOR ELECTRICAL CONNECTOR COMPONENTS

(75) Inventors: Scott P. Marceau, Plainfield, IL (US); Brenda R. Courim, Chicago, IL (US); Frank T. Keyser, Elk Grove Village, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/903,889

(22) Filed: Jul. 12, 2001

(65) Prior Publication Data

US 2003/0013342 A1 Jan. 16, 2003

(51) Int. Cl.[7] ..... H01R 13/60
(52) U.S. Cl. ..... 439/566; 439/371; 156/313
(58) Field of Search ..... 439/566, 717, 439/936, 208, 371; 156/313; 174/259, 260

(56) References Cited

U.S. PATENT DOCUMENTS 4,550,959 A * 11/1985 Grabbe et al. ..... 439/926
4,702,708 A * 10/1987 Reuss et al. ..... 439/83
4,875,259 A * 10/1989 Appeldorn ..... 24/576
5,176,530 A * 1/1993 Reylek et al. ..... 439/290
5,419,801 A * 5/1995 McDonald ..... 156/581
5,664,953 A * 9/1997 Reylek ..... 439/86
5,880,401 A * 3/1999 Leischner et al. ..... 174/66
6,059,483 A * 5/2000 Owens et al. ..... 403/267
6,309,257 B1 * 10/2001 Huang ..... 439/731

* cited by examiner

*Primary Examiner*—P. Austin Bradley
*Assistant Examiner*—Briggitte R Hammond
(74) *Attorney, Agent, or Firm*—Stacey E. Caldwell; A. A. Tirva

(57) ABSTRACT

An interface system is provided for adhering a pair of electrical connector components together. A first connector component has a first interface surface with a first set of elongated, mutually spaced adhesive flow fins. A second connector component has a second interface surface with a second set of elongated adhesive flow fins for disposition between the first set of adhesive flow fins. The flow fins of at least one of the first or second sets thereof are tapered from enlarged ends of the fins to reduced ends thereof for forcing liquid adhesive material between the interface surfaces longitudinally of the fins from the enlarged ends thereof toward the reduced ends thereof automatically when the interface surfaces are brought together.

15 Claims, 2 Drawing Sheets

ADHESIVE INTERFACE FOR ELECTRICAL CONNECTOR COMPONENTS

FIELD OF THE INVENTION

This invention generally relates to the art of electrical connectors and, particularly, to an interface system for facilitating the joining of a pair of electrical connectors by a liquid adhesive.

BACKGROUND OF THE INVENTION

Electrical connector components are joined together by a wide range of systems ranging from simple mechanical fasteners to ultrasonic welding. One type of permanent joining system involves the use of liquid or fluid adhesives. Adhesives are simple and inexpensive to use in comparison to ultrasonic or similar processes. In addition, an adhesive joining system does not take up valuable space or "real estate" in connector assemblies as is required for most mechanical fastening systems.

A problem in using adhesive joining systems involves the application of the liquid over any given interface surface. For instance, a "bead" of adhesive material may be applied to an interface surface, and then the adhesive material must be spread over the entire surface for complete adhesion between the two electrical connector components. The present invention is directed to solving this problem by a unique interface system whereby the adhesive material is spread over the interface surfaces of a pair of electrical connector components automatically as the components are brought together.

SUMMARY OF THE INVENTION

An object, therefore, of the invention is to provide a new interface system for adhering a pair of electrical connector components together.

In the exemplary embodiment of the invention, a first connector component has a first interface surface with a first set of elongated, mutually spaced adhesive flow fins. A second connector component has a second interface surface with a second set of elongated adhesive flow fins for disposition between the first set of adhesive flow fins. The adhesive flow fins of at least one of the first or second sets thereof are tapered from enlarged ends thereof to reduced ends thereof. Preferably, both the first and second sets of adhesive flow fins are tapered in the same direction. This unique system forces liquid adhesive material between the interface surfaces longitudinally of the fins from the enlarged ends thereof toward the reduced ends thereof automatically when the interface surfaces are brought together. In the preferred embodiment, the adhesive flow fins of the first set thereof alternate with the adhesive flow fins of the second set thereof when the connector components are interfaced.

As disclosed herein, the first connector component includes a first housing having a relatively shallow trough defined by opposite side walls and opposite end walls. The first adhesive flow fins are disposed in the trough and extend generally parallel to the side walls thereof. The second connector component includes a second housing having a plug portion insertable into the trough of the first connector component. The second set of elongated adhesive flow fins are disposed on the plug portion for alternate disposition between the first set of adhesive flow fins. Adjacent ends of the first set of adhesive flow fins are spaced from one end wall of the trough to define a cross area for depositing a bead of liquid adhesive therein. The enlarged ends of the first adhesive flow fins are located at the cross area. The plug portion of the second connector component includes a cross wall for insertion into the cross area to squeeze the liquid adhesive therefrom along the adhesive flow fins.

Other features of the invention include at least one standoff on the plug portion of the second connector component to space the plug portion a given distance from a bottom wall of the trough of the first connector component. A side escapement opening is provided between the plug portion of the second connector component and the trough of the first connector component for the escape of excess liquid adhesive therefrom. In the preferred embodiment, the first housing of the first connector component is a cast metal housing, and the second housing of the second connector component is a molded plastic housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
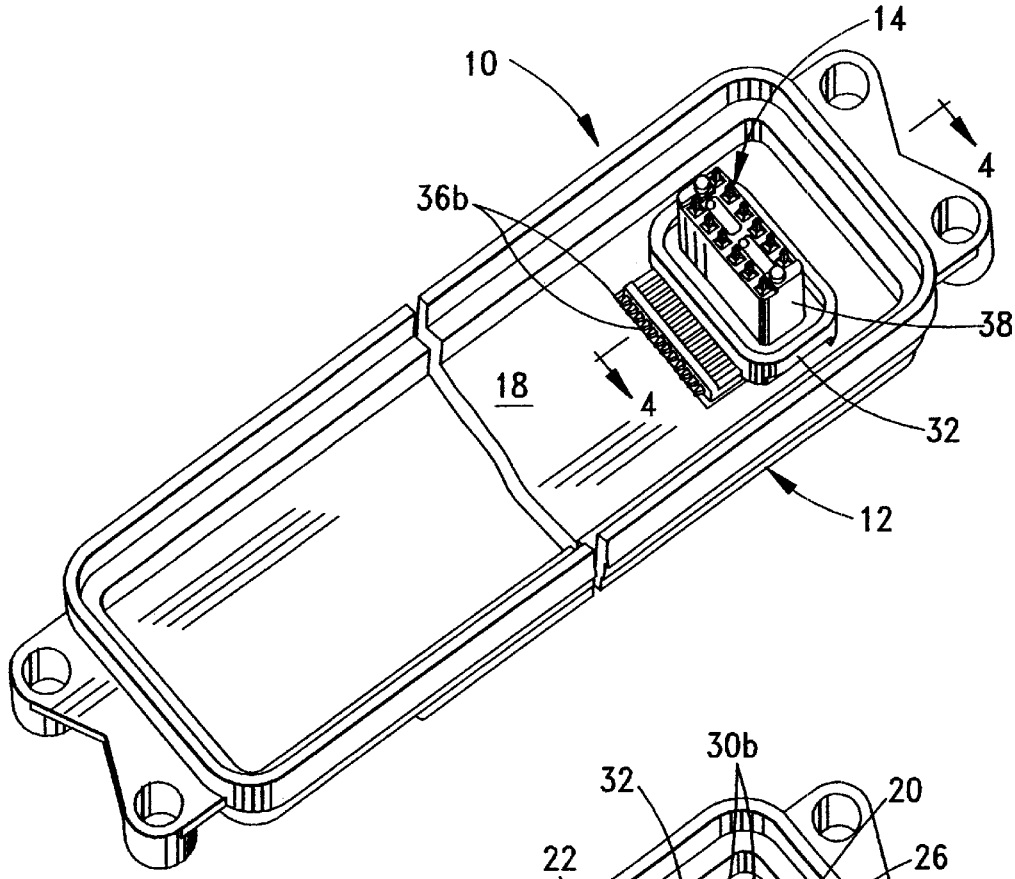
FIG. 1 is a perspective view of an electrical connector assembly embodying the interface system of the invention.

Referring to the drawings in greater detail, and first to FIG. 1, the invention is embodied in an interface system for adhering a pair of electrical connector components together. In FIG. 1, an electrical connector assembly, generally designated 10, includes a first electrical connector component, generally designated 12, on which is mounted a second connector component, generally designated 14. First connector component 12 is an elongated housing of cast metal material such as aluminum. Second connector component 14 is a header connector which is adhesively joined to connector component 12 by the interface system of the invention, as described hereinafter. More than one electrical connector can be mounted on or joined to aluminum casting 12. In addition, the interface system of the invention has a wide range of applications and is not limited to the specific electrical connector assembly 10 shown herein.

Figure 2:
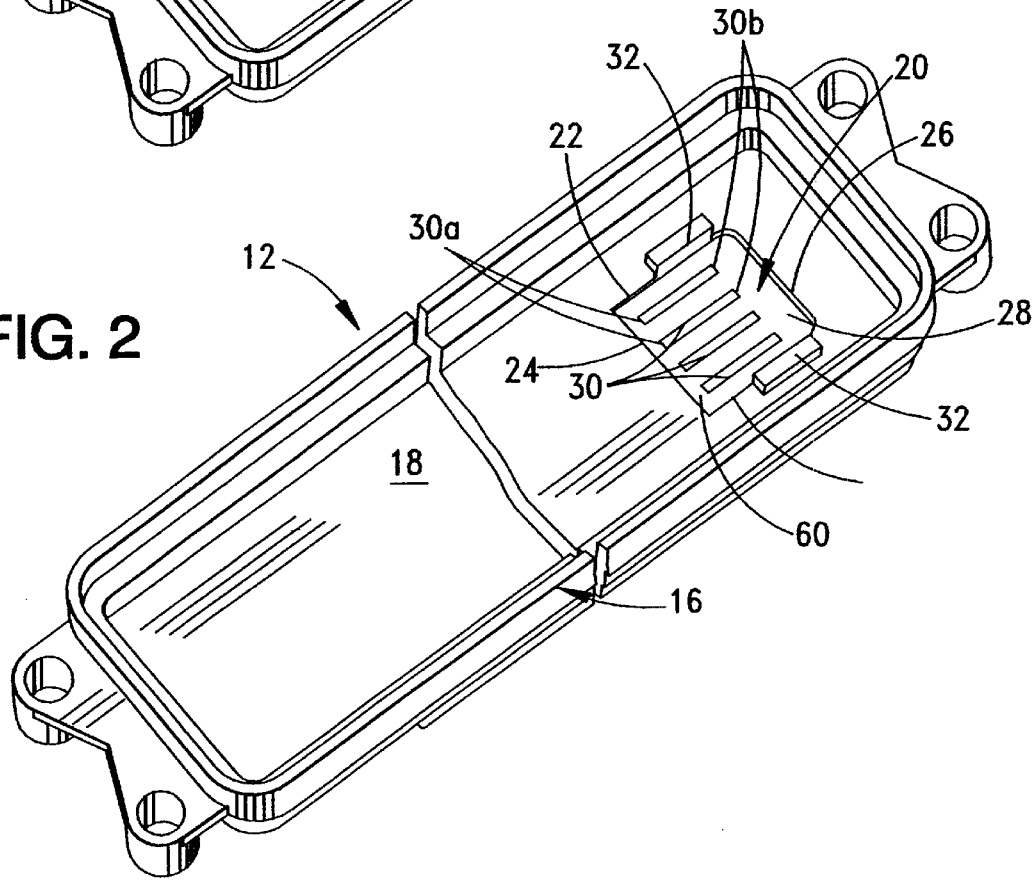
FIG. 2 is a perspective view of the connector assembly, with the header connector removed.

With that understanding, referring to FIG. 2 in conjunction with FIG. 1, first connector component 12 comprises a housing, generally designated 16, which is cast of metal material such as aluminum or the like. The housing has a generally planar wall 18 having a relatively shallow trough, generally designated 20, formed therein. The trough is defined by opposite side walls 22 and opposite end walls 24 and 26, whereby the trough is generally rectangular in configuration. The trough has a bottom wall 28, and a set (four) of elongated, mutually spaced adhesive flow fins 30 extend generally parallel to side walls 22. In the particular application herein, trough 20 may be on the order of 1.5 mm deep. Finally, a pair of upstanding locating bosses 32 are formed at opposite sides of trough 20.

Figure 3:
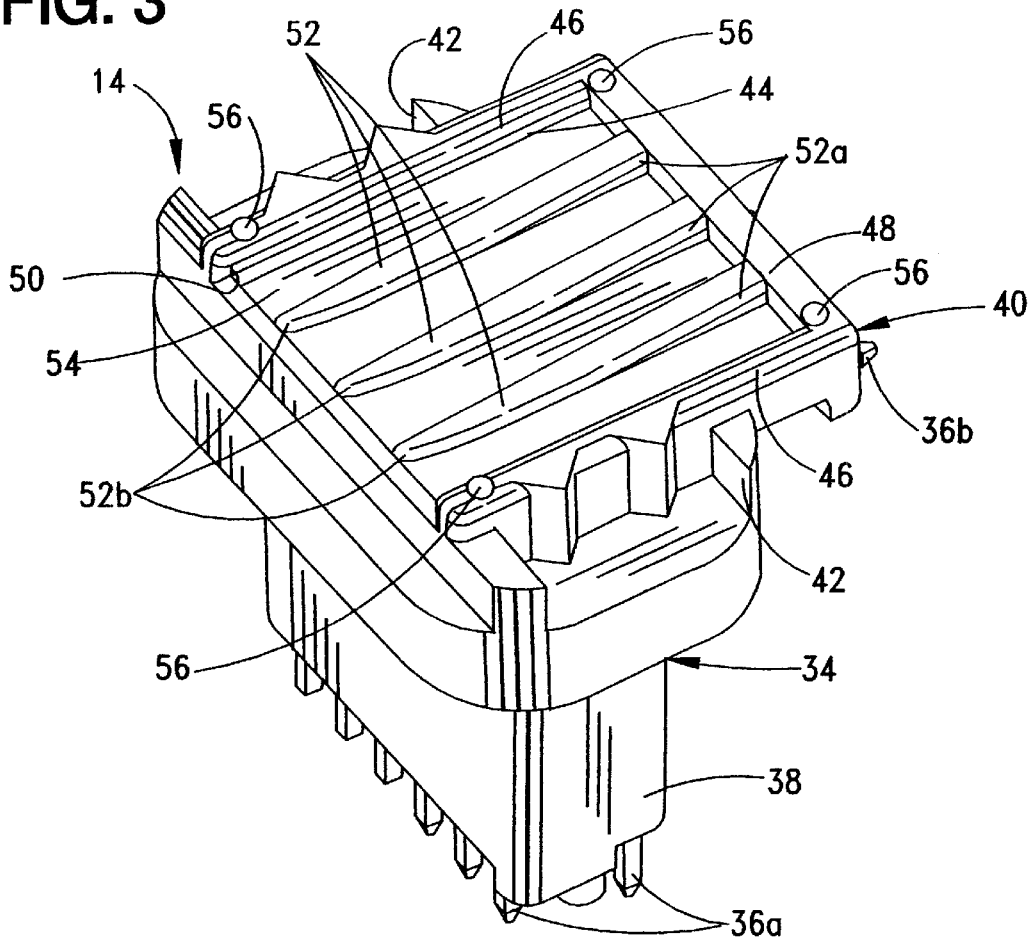
FIG. 3 is an enlarged perspective view of the header connector, looking at the bottom thereof as viewed in FIG. 1.
Figure 4:
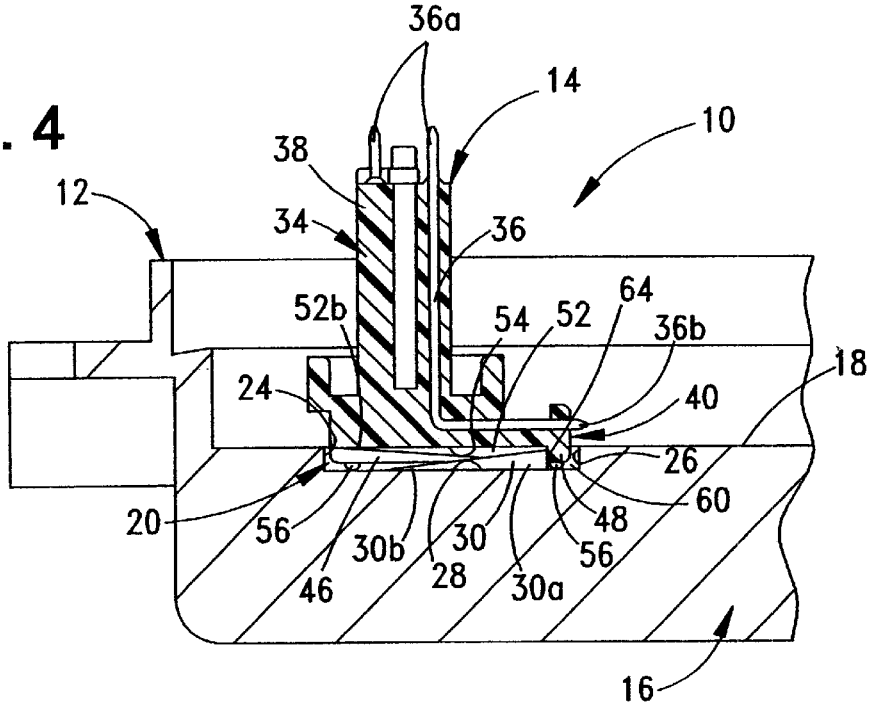
FIG. 4 is an enlarged vertical section taken generally along line 4—4 of FIG.

Referring to FIGS. 3 and 4 in conjunction with FIG. 1, header connector 14 includes a molded plastic housing, generally designated 34, which mounts a plurality of L-shaped terminals 36 as best seen in FIG. 4. The terminals have contact ends 36*a* projecting from a male portion 38 of the header connector for engaging appropriate contacts within a female portion of a complementary mating connector (not shown). The L-shaped terminals 36 have terminating ends 36*b* for connection, as by "wire bonding", to appropriate electrical wires (not shown).

Molded plastic housing 34 of header connector 14 has a plug portion, generally designated 40, which is positionable in registry with trough 20 (FIG. 2) of first connector component 12. Housing 34 has a pair of side notches 42 which receive locating bosses 32 (FIG. 2) at opposite sides of the trough to properly locate the header connector relative to the trough. Plug portion 40, itself, has a trough or recessed area 44 defined by a pair of opposite side walls 46 and a single end wall 48. The opposite end of recessed area 44 is open, as at 50, for purposes described hereinafter. A second set (three) of elongated adhesive flow fins 52 project upwardly from a bottom wall 54 of recessed area 44. The fins extend from end wall 48 generally parallel to and equally spaced between side walls 46. Finally, a plurality of standoff buttons 56 project from the edges of side walls 46 and end wall 48. As seen in FIG. 4, these standoff buttons engage bottom wall 28 of trough 20 to space plug portion 40 of header connector 14 a given distance from the bottom wall of the trough to ensure a proper thickness of adhesive material, as described hereinafter.

According to the invention, at least one of the first or second set of adhesive flow fins 30 or 42, respectively, have tapered configurations. In the preferred embodiment, the adhesive flow fins of both sets thereof have tapered configurations.

More particularly, as best seen in FIG. 4, each adhesive flow fin 30 which projects upwardly from bottom wall 28 of trough 20 of first connector component 12 has an enlarged cross-sectional end 30*a* and a reduced cross-sectional end 30*b*. It also should be noted that enlarged ends 30*a* of flow fins 30 are spaced from end wall 26 of trough 20 to define an open cross area 60. It can be seen in FIG. 2, that open cross area 60 extends entirely across trough 20 between the enlarged ends 30*a* of the adhesive flow fins and end wall 24.

FIG. 3 best shows that adhesive flow fins 52 are tapered from enlarged cross-sectional ends 52*a* to reduced cross-sectional ends 52*b*. Flow fins 52 extend all the way from end wall 48 of plug portion 40 to open end 50 of recessed area 44.

In operation, first connector component or metal casting 12 is positioned upright as shown in FIG. 2. A bead of liquid adhesive material then is deposited by appropriate means into open cross area 60 immediately inside end wall 24 of trough 20 alongside enlarged ends 30*a* of adhesive flow fins 30. Header connector 14 then is aligned for positioning plug portion 40 thereof into trough 20. Proper positioning is facilitated by locating bosses 32 at opposite sides of the trough. When properly positioned, end wall 48 of the plug portion is pushed into open cross area 60 of trough 20 as seen in FIG. 4. In other words, end wall 48 is forced into the bead of adhesive material. The adhesive material then is forced longitudinally along adhesive flow fins 30 and 52. Because the enlarged ends 30*a* and 52*a* of the fins are located nearest the initial bead of adhesive material, the total spacing around the fins between bottom wall 28 of trough 20 and bottom wall 54 of recessed area 44 is minimal to cause further squeezing of the adhesive material toward the reduced ends 30*b* and 52*b* of the adhesive flow fins where the spacing between the connector components is greater. In essence, an expanding interface area is created by the alternating tapered adhesive flow fins whereby the liquid adhesive material flows along the path of least resistance and spreads longitudinally from the restricted spacing around the enlarged ends of the fins to the more open spacing around the reduced ends of the fins. Therefore, the liquid adhesive material is spread automatically simply by properly locating header connector 14 onto connector component 12.

As stated above, standoff buttons 56 properly space the components and, in essence, define a datum plane therefor. A datum plane 64 (FIG. 4) also is formed between end wall 48 of the header connector and enlarged ends 30*a* of flow fins 30 of connector component 12. Finally, open end 50 of recessed area 44 allows excess adhesive material to move out of trough 20 at a location remote from terminating ends 36*b* of terminals 36 so that the adhesive material does not interfere with proper termination of the terminals to appropriate electrical wires, for instance.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A system for adhering a pair of electrical connector components together, comprising:

a first connector component including a first housing having a relatively shallow trough defined by opposite side walls and opposite end walls, and a first set of elongated, mutually spaced adhesive flow fins in the trough and extending generally parallel to said side walls;

a second connector component including a second housing having a plug portion insertable into said trough, and a second set of elongated adhesive flow fins on the plug portion for alternate disposition between said first set of adhesive flow fins; and wherein the adhesive flow fins of at least one of said first and second sets thereof are tapered from enlarged cross-sectional ends of the fins to reduced cross-sectional ends thereof for forcing liquid adhesive material between the components longitudinally of the fins from said enlarged ends toward said reduced ends.

2. The system of claim 1 wherein both said first and second sets of adhesive flow fins are tapered.

3. The system of claim 1 wherein the plug portion of said second connector component includes at least one standoff to space the plug portion a given distance from a bottom wall of the trough of the first connector component.

4. The system of claim 1, including a side escapement opening between the plug portion of the second connector component and the trough of the first connector component for the escape of excess liquid adhesive therethrough.

5. The system of claim 1 wherein adjacent ends of said first set of adhesive flow fins are spaced from one end wall of said trough to define a cross area for depositing liquid adhesive therein.

6. The system of claim 5 wherein the enlarged ends of said at least one set of adhesive flow fins are located at said cross area.

7. The system of claim 6 wherein the plug portion of said second connector component includes a cross wall for insertion into said cross area to squeeze the liquid adhesive therefrom longitudinally along the adhesive flow fins.

8. The system of claim 1 wherein the first housing of said first connector component comprises a cast metal housing.

9. The system of claim 8 wherein the second housing of said second connector component comprises a molded plastic housing.

10. An interface system for adhering a pair of electrical connector components together, comprising:

a first connector component having a first interface surface with a first set of elongated, mutually spaced adhesive flow fins;

a second connector component having a second interface surface with a second set of elongated adhesive flow fins for disposition between said first set of adhesive flow fins; and wherein the adhesive flow fins of at least one of said first and second sets thereof are tapered in a longitudinal direction of the fins from enlarged ends thereof to reduced ends thereof for forcing liquid adhesive material between the interface surfaces longitudinally of the fins from said enlarged ends thereof toward said reduced ends there automatically when the interface surfaces are brought together.

11. The interface system of claim 10 wherein both said first and second sets of adhesive flow fins are tapered.

12. The interface system of claim 10 wherein the adhesive flow fins of the first set thereof alternate with the adhesive flow fins of the second set thereof when the connector components are interfaced.

13. The interface system of claim 10, including standoff means on at least one of said connector components for maintaining a given spacing between said interface surfaces.

14. The interface system of claim 10 wherein said first connector component is a cast metal component.

15. The interface system of claim 14 wherein said second connector component is a molded plastic component.

* * * * *